US009002025B2

(12) United States Patent
Marten

(10) Patent No.: US 9,002,025 B2
(45) Date of Patent: Apr. 7, 2015

(54) HEADSET

(75) Inventor: Stefan Marten, Wedemark (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 1064 days.

(21) Appl. No.: 12/638,288

(22) Filed: Dec. 15, 2009

(65) Prior Publication Data

US 2010/0158264 A1 Jun. 24, 2010

(30) Foreign Application Priority Data

Dec. 15, 2008 (DE) ..... 20 2008 016 442 U

(51) Int. Cl.
*H04R 1/10* (2006.01)
*H04R 5/033* (2006.01)

(52) U.S. Cl.
CPC ..... *H04R 1/1041* (2013.01); *H04R 1/1066* (2013.01); *H04R 5/033* (2013.01); *H04R 2201/107* (2013.01); *H04R 2201/109* (2013.01)

(58) Field of Classification Search
USPC ..... 381/74, 374, 375, 122, 123; 379/428.02, 433.03, 428.01; 455/575.2
See application file for complete search history.

(56) References Cited

U.S. PATENT DOCUMENTS

| | | | | |
|---|---|---|---|---|
| 7,885,419 | B2 * | 2/2011 | Wahl et al. | 381/74 |
| 2008/0089545 | A1 * | 4/2008 | Jannard et al. | 381/374 |
| 2010/0296684 | A1 * | 11/2010 | Eberl et al. | 381/378 |
| 2012/0020491 | A1 * | 1/2012 | Dory | 381/74 |

* cited by examiner

*Primary Examiner* — Vivian Chin
*Assistant Examiner* — Con P Tran
(74) *Attorney, Agent, or Firm* — Kilpatrick Townsend & Stockton LLP

(57) ABSTRACT

Disclosed is a headset, and a method of switching a first input signal for a left ear and a second input signal for a right ear of a user.

5 Claims, 2 Drawing Sheets

HEADSET

CROSS-REFERENCE TO RELATED APPLICATIONS

The present application claims priority to German Patent Application No. 20 2008 016 442.7, filed Dec. 15, 2008, the entire contents of which is herein incorporated by reference in its entirety for all purposes.

The invention concerns a headset, and a method of switching a first input signal for a left ear and a second input signal for a right ear.

Headsets are known which have a first and a second earphone capsule. The two earphone capsules are connected to a headband or a behind-the-neck band. A microphone arm can be fixed to one of the earphone capsules or to the headband or behind-the-neck band, the microphone arm holding a microphone in the proximity of the mouth opening of a user. Headsets of that kind can be fitted by a user in two ways. Either the microphone is at the right-hand side of a user or it is at the left-hand side. So that the microphone arm can face towards the mouth opening of the user in both cases, it is designed to be pivotable. In general an axis member about which the microphone arm can be pivoted is disposed on the earphone capsule or the band to which the microphone arm is fixed.

Accordingly such a headset can be fitted in such a way that the first earphone capsule is either at the left or at the right ear of the user. The second earphone capsule is then disposed at the respective other ear and the pivotable microphone arm is so adjusted that it faces towards the mouth opening.

The object of the present invention is to provide a headset which permits reproduction of an audio signal in the correct manner in respect of side, irrespective of how the headset is fitted around the head.

The object is attained by a headset as set forth in claim 1 for receiving a first input signal for a left ear and a second input signal for a right ear.

Thus there is provided a headset having a first earphone capsule for a first ear of a user, a second earphone capsule for a second ear of the user and a microphone arm which is movable at least from a first position setting into a second position setting. In that case a first input signal for a left ear and a second input signal for a right ear can be fed to the headset. The headset also has a switching unit adapted to associate the first input signal with the first earphone capsule and the second input signal with the second earphone capsule when the microphone arm is in the first position setting and adapted to associate the first input signal with the second earphone capsule and the second input signal with the first earphone capsule when the microphone arm is in the second position.

The invention is based on the notion that it is possible to deduce from the position of the microphone arm, which of the two earphone capsules is at the left ear of a user and which is at the right ear of a user. It is assumed in that respect that the microphone arm is oriented in the direction of the mouth opening of a user. If the microphone arm is for example fixed to a first earphone capsule which is for example at the left ear of a user, the microphone arm faces forwardly, for example at an angle of −120° relative to a carrier of the two earphone capsules, which extends parallel to a longitudinal axis of the body of the user. Turning the headset round, that is to say interchanging the earphone capsules on the ears, requires the microphone arm to be pivoted or changed over. After the pivotal movement the microphone arm is in a new position which is determined for example by an angle of for example +120° between the microphone arm and a carrier of the earphone capsules. When the microphone arm is in that position the first earphone capsule is then at the right ear. In dependence on the microphone arm position, the association of the first and second input signals with the first and second earphone capsules, in correctly sided relationship, is effected in an automated procedure.

The first earphone capsule and the second earphone capsule can be connected by way of a band which can be held for example by the head of a user. The microphone arm is for example in the form of a pivotal arm which has a microphone at its tip. The microphone arm can be fixed for example to the first earphone capsule, the second earphone capsule or also to the band. The pivotal movement of a microphone arm signifies for example a circular movement about an axis point. The microphone arm is for example made of a flexible material so that the microphone arm can be so oriented that the microphone faces towards the mouth opening of a user.

The first position or position setting can also include a range of positions described for example by a range of between 0 and 180°, preferably between 10 and 180°, between the carrier and the microphone arm. Likewise the second position or position setting can include a range of positions which is for example within the angular limits of between 0 and −180°, preferably between −10 and −180°, wherein the angle is specified between the carrier and the microphone arm. The carrier extends at least partially along a longitudinal axis of the body. The microphone arm can be pivoted for example from a first position into a second position. Equally it is conceivable that the microphone arm is removed from the headset and re-fitted in another position.

An earphone capsule includes an acoustic transducer for converting the first or the second input signal into a corresponding sound signal which is to be passed to an ear of a user. The acoustic transducer is generally disposed in a housing or in a capsule which is held to or in the ear of a user.

The invention is based on the realisation that, in many audio applications, it is necessary to feed the left ear with a first audio signal which is intended for the left ear and the right ear with a second audio signal which is intended for the right ear. The functionality of a headset with two microphone capsules can be markedly improved by such reproduction of the audio signals, in correctly sided relationship, in such a headset. By way of example in that way directional information, for example the direction of a sound source, can be transmitted to the user. For example in the case of three-dimensional audio (3D audio), reproduction in correctly sided relationship must be implemented under all circumstances. 3D audio produces for example the illusion of sound sources which are arranged as desired in a 3-dimensional space around the user.

In that respect the problem which now arises is that the above-described headset can be fitted in two ways by a user. In that respect the first earphone capsule is at the left ear and the second earphone capsule is at the right ear, or however the first earphone capsule is at the right ear and the second earphone capsule is at the left ear.

In accordance with a further aspect of the invention the switching unit has a change-over switch for switching over the first input signal and the second input signal, the switch being actuable mechanically by a pivotal movement of the microphone arm. After a headset has been fitted the microphone arm is generally moved or pivoted into a position in which it faces towards the mouth opening of the user. That movement can actuate a change-over switch which allocates the first input signal and the second input signal to the first earphone capsule and the second earphone capsule in correctly sided relationship. That provides for simple left/right switching-over of the input signals in correctly sided relationship.

In accordance with a further aspect of the invention the switching unit includes a relay. The relay serves for switching over the first and the second input signals. It is switched on the basis of a query in respect of the microphone arm position or detection of the microphone arm position.

In accordance with a further aspect of the invention the headset has a sensor element for querying a position of the microphone arm. Such a sensor element can for example replace the change-over switch and feed the switching unit with a corresponding sensor signal which specifies the position of the microphone arm. The sensor element can be for example in the form of an optoelectronic element for optoelectronic querying of the microphone arm position. Equally the sensor element can be implemented by a magnet or by position sensors. In that way for example it is possible to establish more than a first and a second position or two ranges of positions of the microphone arm, wherein those further positions can be used for further functional controls for the headset, for example volume regulation. The relay can be switched in dependence on a query in respect of the microphone arm position or in dependence on the sensor signal.

In accordance with a further aspect of the present invention the switching unit has an electronic element which is adapted on the basis of a sensor signal to provide for switching over the first input signal and the second input signal. The electronic element can be for example a programmable processor unit or an application specific integrated circuit (ASIC). The electronic element can also be designed in such a way that it implements further functions of the headset such as for example volume regulation in dependence on the microphone arm position.

The invention also concerns a method of controlling a headset comprising a first earphone capsule for a first ear of a user, a second earphone capsule for a second ear of a user and a microphone arm which is movable at least between a first position and a second position, wherein the method comprises the steps: determining whether the microphone arm is in the first position or in the second position; associating a first input signal for a left ear with the first earphone capsule and the second input signal for a right ear with the second earphone capsule when the microphone arm is in the first position; and associating the first input signal with the second earphone capsule and the second input signal with the first earphone capsule when the microphone is in the second position. That makes it possible to provide that the first input signal and the second input signal are reproduced in correctly sided relationship. The first position can also describe a first range of positions and the second position a second range of positions. A movement of the microphone arm can be achieved in particular by a pivotal movement about an axis point arranged for example on an earphone capsule, or by removal and re-fitting in a different position.

The invention also concerns a computer program product which enables a programmable processor unit of a headset to carry out the method according to the invention of switching a first input signal for a left ear and a second input signal for a right ear. In particular the computer program product can add further functionality such as for example volume regulation in interplay with the processor unit and the headset.

The embodiments by way of example and advantages of the present invention are described in greater detail hereinafter with reference to the accompanying drawings.

FIG. 1 shows a plan view of a headset 1 in a first wearing position.

Figure 1:
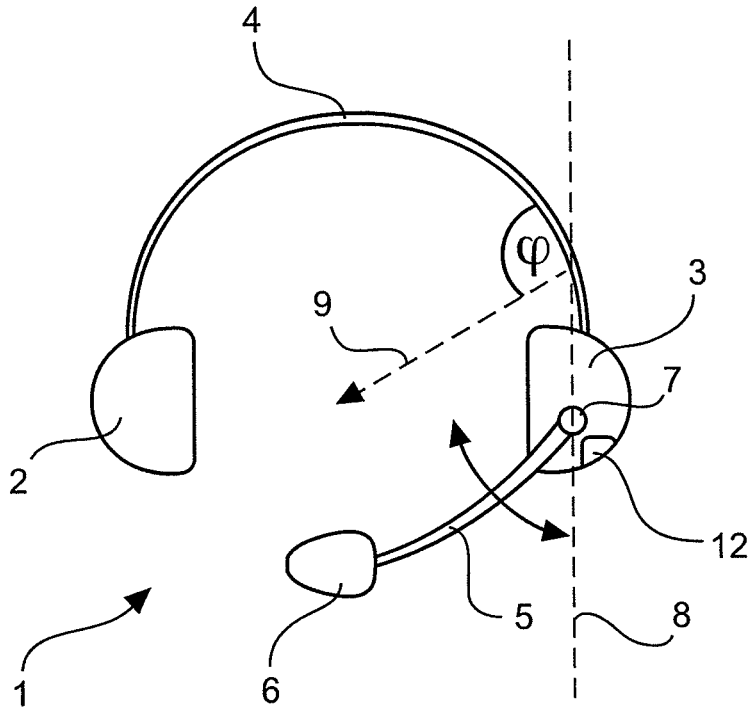
FIG. 1 shows a diagrammatic view of a headset in a first wearing position in accordance with a first embodiment.

The headset 1 has a first earphone capsule 2 and a second earphone capsule 3. The first earphone capsule 2 and the second earphone capsule 3 are connected together by way of a band 4. A microphone arm 5 is mounted to the earphone capsule 3. The microphone arm has a microphone 6 at one end. An axis point or an axis member 7 is disposed on the earphone capsule 3. The axis point or the axis member can also be provided on the band. The first earphone capsule 2 and the second earphone capsule 3 each have a respective acoustic transducer which converts a first input signal and a second input signal respectively into a corresponding acoustic sound. The headset 1 has a switching unit 12 which serves for switching over the first input signal and the second input signal.

The first wearing position of the headset 1 is distinguished in that the first earphone capsule 2 is at the right ear of a user and the second earphone capsule 3 is at the left ear of the user. The band 4 which connects the first earphone capsule 2 and the second earphone capsule 3 and holds them in the correct position is worn by the head of the user. The microphone arm 5 is movable. In particular it can be pivoted about the axis point 7. In addition the microphone arm can be flexible so that the microphone 6 can be easily arranged in the proximity of the mouth opening of the user. The microphone arm 5 is in a first position or in a first range of positions which is distinguished in that the microphone arm in the first wearing position faces in the direction of the mouth opening of the user. The first position setting or position or the first position range can be specified for example by an angle $\phi$ which describes the angle between a longitudinal axis 8 of the body and a direction 9 of the microphone arm at the axis point 7. In FIG. 1 the angle $\phi$ is about 120°. The first position range can include for example angles of between 0 and 180°, preferably between 10 and 180°. The information that the microphone arm is in the first position range can be detected for example with a change-over switch, with optoelectronic elements, with magnets or by position sensors.

When the microphone arm 5 faces towards the mouth opening of the user in the first wearing mode (first earphone capsule 2 at the right ear and the second earphone capsule 3 at the left ear), it is possible to recognise that first wearing position by measuring or detecting that position or that position range. In some audio applications, for example 3D audio, it is necessary for audio signals to be reproduced in correctly sided relationship. That means that a first input signal is to be associated with a left ear of the user and a second input signal is to be associated with a right ear. That is necessary for example to be able to acoustically transmit directional information. When the headset is in the first wearing mode (first earphone capsule 2 at the right ear and second earphone capsule 3 at the left ear), then the first input signal for a left ear and the second input signal for a right ear are respectively passed to the correctly sided earphone capsule when the microphone arm is in the first position or in the first range of positions.

Figure 2:
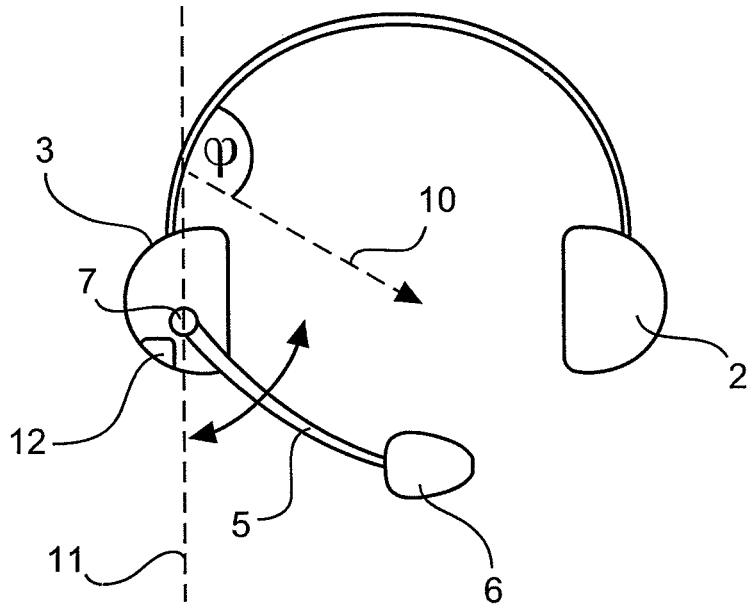
FIG. 2 shows a diagrammatic view of a headset in accordance with a first embodiment in a second wearing position.

However the headset as shown in FIG. 1 can also be used by a user in a second wearing mode in which the first earphone capsule 2 is at the left ear of the user and the second earphone capsule 3 is at the right ear. If the microphone arm 5 is so positioned that, in that second wearing mode, the microphone 6 is at the mouth opening of the user, then the microphone arm is in a second position or in a second range of positions. That can be specified for example by the angle ϕ between a longitudinal axis 8 of the body and a second direction 10 of the microphone arm 5 at the axis point 7. The second longitudinal axis 11 of the body as shown in FIG. 2 is displaced in parallel relationship with the longitudinal axis 8 of the body as shown in FIG. 1. The angle ϕ is at about −120° in FIG. 2, in which case that angle is now in a second range of positions which is within the angles between 0 and −180°, preferably between −10 and −180°, for ϕ.

If it is assumed that the microphone arm 5 is at the second earphone capsule 3 and is facing towards the mouth opening of a user, it is possible to conclude from the position of the microphone arm in the second range that the first earphone capsule 2 is at the left ear of the user and the second earphone capsule 3 is at the right ear. When the microphone arm is in the second range of positions accordingly the first input signal for the left ear must be associated with the first earphone capsule 2 and the second input signal for the right ear of a user must be associated with the second earphone capsule 3 to ensure correctly sided reproduction. The first input signal for a left ear is switched between the first earphone capsule 2 and the second earphone capsule 3 in dependence on the position of the microphone arm. Likewise the second input signal for the right ear is switched in dependence on the position of the microphone arm between the second earphone capsule and the first earphone capsule. Irrespective of whether the headset as shown in FIG. 1 is worn in the first wearing mode or as shown in FIG. 2 in the second wearing mode, the first input signal and the second input signal are accordingly distributed in correctly sided relationship to the first earphone capsule 2 and the second earphone capsule 3 when the microphone arm is moved approximately to the mouth opening of the user.

Figure 3:
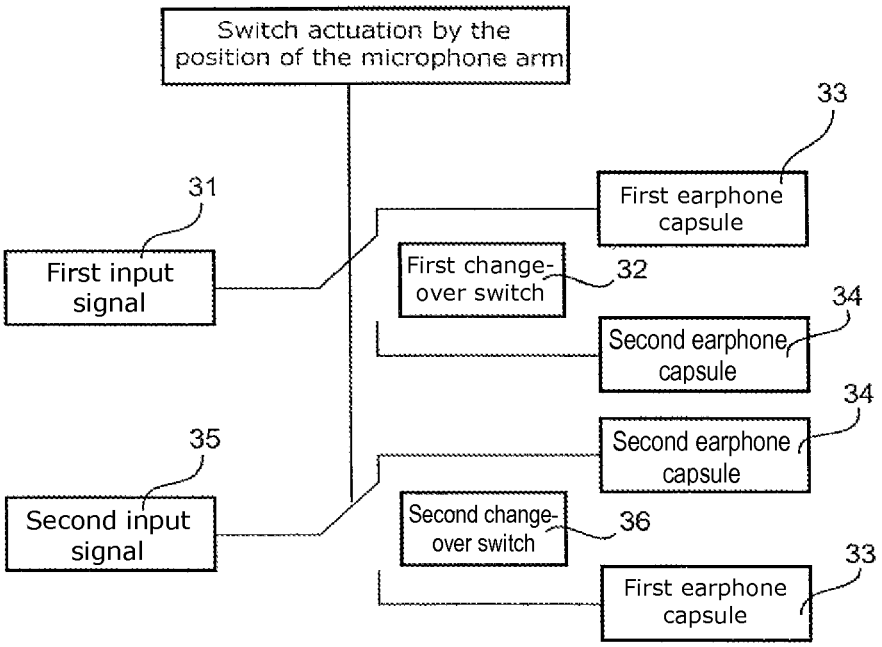
FIG. 3 shows a diagrammatic view of a headset in accordance with a second embodiment.

FIG. 3 shows a diagrammatic view of a headset in accordance with a second embodiment. A first input signal 31 is passed by way of a first change-over switch 32 either to a first earphone capsule 33 or a second earphone capsule 34. The second input signal 35 is passed by way of a second change-over switch 36 either to the second earphone capsule 34 or the first earphone capsule 31. In this case the first input signal 31 and the second input signal 35 are fed to different earphone capsules, that is to say the first input signal 31 is applied to the first earphone capsule 33 when the second input signal 35 is at the second earphone capsule 34 and the first input signal 31 is at the second earphone capsule 34 when the second input signal 35 is at the first earphone capsule 33. The positions of the first change-over switch 32 and the second change-over switch 36 are determined by the position of the microphone arm. By way of example a switch can be mechanically tripped by the pivotal movement of the microphone arm from the first range of positions into the second range of positions or vice-versa so that the first input signal 31 and the second input signal 35 are switched over between the first earphone capsule 33 and the second earphone capsule 34.

The switching-over operation can for example also be effected by way of a relay. The microphone arm position can not only be queried by a mechanical change-over switch but for example also by other sensor elements such as optoelectronic elements and magnets or position sensors. The switching-over operation can also take place in an electronic element, for example a programmable processor unit or an application specific integrated circuit (ASIC). The corresponding sensor signal is then passed to that processor unit and a switching-over operation is effected on the basis of a corresponding control by the processor unit. The processor unit can also perform further functions of the headset, for example volume regulation. The position of the microphone arm can not only be subdivided into a first position range and a second position range, but it is possible to define a multiplicity of positions which are used for controlling given functions of the headset. Such a function can be for example volume regulation. The processor unit can also be adapted to implement the corresponding further functions such as for example volume regulation. In particular control of the change-over switch, querying of the sensor unit and/or the implementation of the further functions can be performed by suitable software which can be run on the processor unit.

The invention claimed is:

1. A headset for receiving a first audio signal for a left ear and a second audio signal for a right ear, comprising:

a first earphone capsule for a first ear of a user;

a second earphone capsule for a second ear of the user;

a band, the first earphone capsule and the second earphone capsule connected together by way of the band;

a microphone arm being fixed to the first earphone capsule and having at least a first and a second position setting, wherein in the first position setting the microphone arm is orientated in the direction of the mouth opening of a user when the first earphone capsule is worn on the left ear of the user and wherein in the second position setting the microphone arm is orientated in the direction of the mouth opening of a user when the first earphone capsule is worn on the right ear of the user; and a switching unit for associating the first audio signal with the first earphone capsule and the second audio signal with the second earphone capsule when the microphone arm is in the first position setting and for associating the first audio signal with the second earphone capsule and the second audio signal with the first earphone capsule when the microphone arm is in the second position setting, wherein the first audio signal is different from the second audio signal.

2. A headset as set forth in claim 1 wherein the switching unit has a change-over switch for switching over the first audio signal and the second audio signal, which change-over switch is actuable mechanically by a pivotal movement of the microphone arm.

3. A headset for receiving a first input signal for a left ear and a second input signal for a right ear, comprising:

a first earphone capsule for a first ear of a user;

a second earphone capsule for a second ear of the user;

a microphone arm having at least a first and a second position setting; and a switching unit for associating the first input signal with the first earphone capsule and the second input signal with the second earphone capsule when the microphone arm is in the first position setting and for associating the first input signal with the second earphone capsule and the second input signal with the first earphone capsule when the microphone arm is in the second position setting, wherein the switching unit has a relay which is switched on the basis of a query of a position setting of the microphone arm.

4. A headset for receiving a first input signal for a left ear and a second input signal for a right ear, comprising:

a first earphone capsule for a first ear of a user;

a second earphone capsule for a second ear of the user;

a microphone arm having at least a first and a second position setting;

a switching unit for associating the first input signal with the first earphone capsule and the second input signal with the second earphone capsule when the microphone arm is in the first position setting and for associating the first input signal with the second earphone capsule and the second input signal with the first earphone capsule when the microphone arm is in the second position setting; and a sensor element for querying a position setting of the microphone arm.

5. A headset for receiving a first input signal for a left ear and a second input signal for a right ear, comprising:

a first earphone capsule for a first ear of a user;

a second earphone capsule for a second ear of the user;

a microphone arm having at least a first and a second position setting; and a switching unit for associating the first signal with the first earphone capsule and the second signal with the second earphone capsule when the microphone arm is in the first position setting and for associating the first signal with the second earphone capsule and the second signal with the first earphone capsule when the microphone arm is in the second position setting, wherein the switching unit has an electronic element adapted to perform switching-over of the first input signal and the second input signal on the basis of a sensor signal.

* * * * *

UNITED STATES PATENT AND TRADEMARK OFFICE

CERTIFICATE OF CORRECTION

PATENT NO. : 9,002,025 B2
APPLICATION NO. : 12/638288
DATED : April 7, 2015
INVENTOR(S) : Stefan Marten It is certified that error appears in the above-identified patent and that said Letters Patent is hereby corrected as shown below:

In the claims

Claim 1; Column 6;
Line 23, Delete "ear of the user and wherein in the second position setting" and insert
-- ear of the user, and wherein in the second position setting --

Claim 1; Column 6;
Line 30, Delete "arm is in the first position setting and for associating the" and insert
-- arm is in the first position setting, and for associating the --

Claim 2; Column 6;
Line 38, Delete "audio signal and the second audio signal, which change-over" and insert
-- audio signal and the second audio signal, wherein the change-over --

Claim 3; Column 6;
Line 50, Delete "arm is in the first position setting and for associating the" and insert
-- arm is in the first position setting, and for associating the --

Claim 4; Column 6;
Line 66, Delete "arm is in the first position setting and for associating the" and insert
-- arm is in the first position setting, and for associating the --

Claim 5; Column 7;
Line 15, Delete "first position setting and for associating the first signal with" and insert
-- first position setting, and for associating the first signal with --

Signed and Sealed this
Third Day of November, 2015

Michelle K. Lee

Michelle K. Lee
*Director of the United States Patent and Trademark Office*